US005193232A

United States Patent [19]

Flood et al.

[11] Patent Number: 5,193,232

[45] Date of Patent: Mar. 16, 1993

[54] COLLAPSIBLE BED-PAN SUPPORT FOR INVALIDS

[76] Inventors: Robert Flood, 135 W. Lobos Marinos; Robert Markus, 247 Ave. Del Poniente, Apt. D2, both of San Clemente, Calif. 92672

[21] Appl. No.: 759,917

[22] Filed: Sep. 13, 1991

Related U.S. Application Data

[63] Continuation-in-part of Ser. No. 658,518, Feb. 21, 1991, abandoned.

[51] Int. Cl.[5] ..... A61G 9/00

[52] U.S. Cl. ..... 4/457; 4/456

[58] Field of Search ..... 4/450–457

[56] References Cited

U.S. PATENT DOCUMENTS

| | | | |
|---|---|---|---|
| 931,539 | 8/1909 | Williams et al. | 4/450 |
| 1,091,352 | 3/1914 | Knowlton | 4/450 |
| 1,695,160 | 12/1928 | Sherran | 4/456 |
| 4,207,633 | 6/1980 | Smith et al. | 4/456 X |

*Primary Examiner*—Charles E. Phillips
*Attorney, Agent, or Firm*—Milton S. Gerstein

[57] ABSTRACT

A collapsible bed-pan support or pad for bed-ridden persons. The pad has a U-shaped opening provided with a pair of camming, catch members for removably retaining a bed pan in place. The U-shaped opening is reinforced along its annular wall to prevent bulging, in order to better retain the bed pan in the U-shaped opening of the pad. A bottom apron is provided to protect bed sheets while the bed pan is being used. A specially-designed bed pan cooperates with the camming members of the pad to retain the bed pan in place.

16 Claims, 4 Drawing Sheets

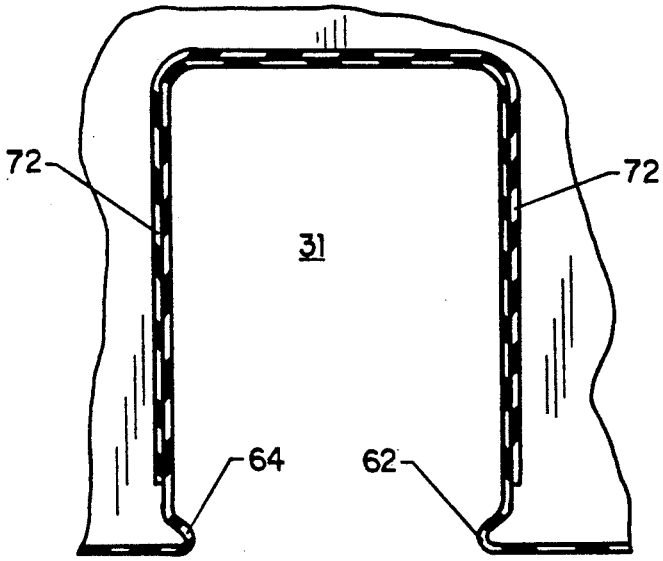
FIG. 4
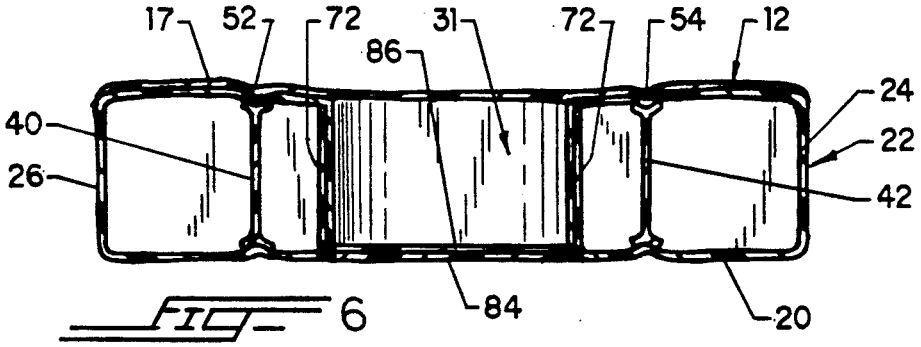
FIG. 6
FIG. 5
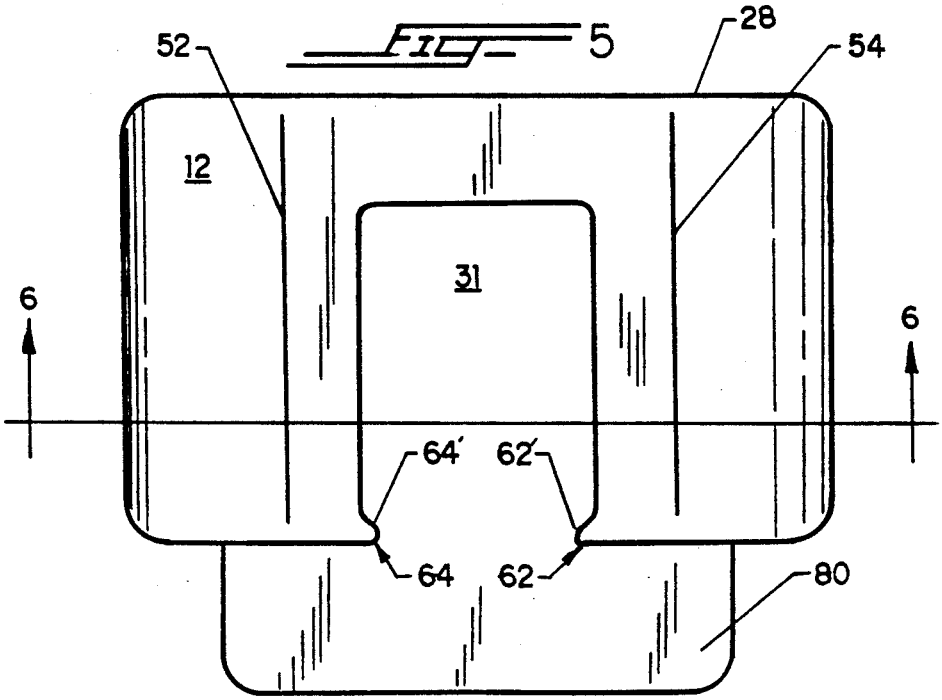

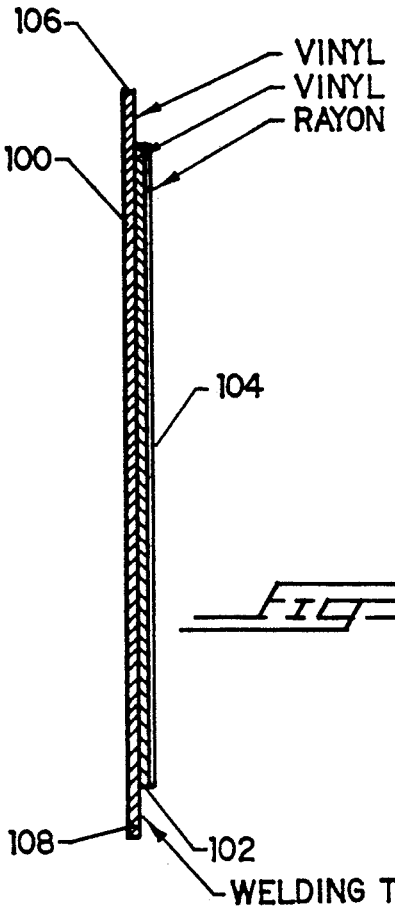
FIG 9
FIG 10A
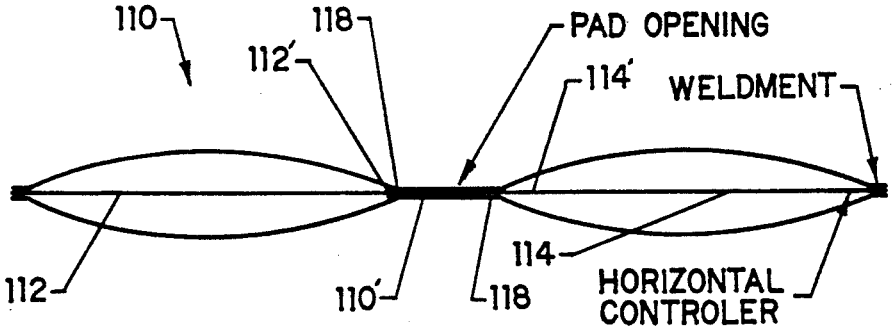
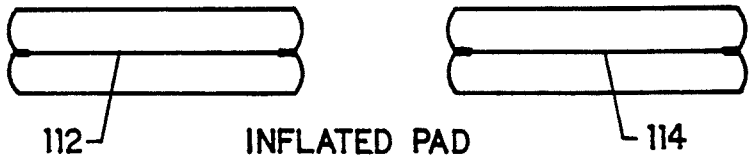
FIG 10B

COLLAPSIBLE BED-PAN SUPPORT FOR INVALIDS

CROSS REFERENCE TO RELATED APPLICATION

The present application is a continuation-in-part application of copending application Ser. No. 07/658,518, filed on Feb. 21, 1991 abandoned.

BACKGROUND OF THE INVENTION

The present invention is directed to a collapsible support for a bed-pan for use in hospitals or in the home for persons that are too ill to leave the bed. Inflatable bed-pan supports are known, one such being disclosed in U.S. Pat. No. 3,728,744—Kimbro, et al. Another bed-pan support is disclosed in U.S. Pat. No. 4,207,633—Smith et al. While these prior-art bed-pan supports are useful, they do not provide the comfort, ease of use, and support as that of the present invention. The prior-art, inflatable bed-pan supports generally must be repositioned under the patient each time the bed pan is to be used, and then inflated. After use, the support is deflated and then removed for subsequent use. These prior-art devices suffer from serious disadvantages when used by obese persons.

SUMMARY OF THE INVENTION

It is, therefore, the primary objective of the present invention to provide an inflatable, collapsible bed-pan support or pad for use in hospitals as well as in the home for bed-ridden persons which provides much greater ease of use, and provides enhanced structural support, while also providing greater comfort.

It is another objective of the present invention to provide an inflatable, bed-pan pad that is generally made of vinyl, and which is provided with a laminated layer of rayon, or similar material, on the upper, patient-contacting surface, which layer of rayon is located on the outside of the pad in order to provide greater comfort. The U-shaped opening of the pad, which receives a bed pan therein, is also provided with a laminated layer of rayon on the inside thereof, in order to enhance the structural integrity thereof, in order prevent excessive bulging out of the annular wall of the U-shaped opening, which bulging would tend to make insertion and retention of a bed pan therein more tenuous. The pad is also provided with a bottom, apron member for protecting the sheets of the bed from soiling, which apron is also provided with a bottom, laminated layer of rayon for increasing the coefficient of friction of the apron, in order to prevent slipping and sliding of the apron, and, thus, the pad and bed pan, whereby a more stable waste-receiving device for bed-ridden patients is achieved. The U-shaped opening of the pan is provided with a narrow, front insertion-opening defining a pair of diametrically-opposed camming members, or ears, that resiliently hold and latch the novel bed pan of the invention, which bed pan has a pair of laterally-opposed notches or cutouts formed in its upper, forward corners thereof, which cutouts cooperate with the pair of ears for achieving the resilient latching of the bed pan in the U-shaped opening of the pad of the invention. The pad is concave-shaped in order to match the contour of the back of the patient, to provide greater comfort. A pair of internal I-beams made of vinyl connect the bottom and top surfaces together to provide strength when the pad is inflated, and which I-beams also cause a linear depression along the upper surface of the pad when the pad is inflated, in order to form depressions for the thighs of the patient, in order to stabilize the legs of patient on the pad.

BRIEF DESCRIPTION OF THE DRAWINGS

The invention will be more readily understood with reference to the accompanying drawing, wherein:

FIG. 4 is a top, cross-sectional view of the collapsible bed-pan support or pad of the invention;

FIG. 5 is a top, plan view thereof showing the bottom apron thereof;

FIG. 6 is a cross-sectional view taken along line 6—6 of FIG. 5;

FIG. 9 is a cross-sectional view of a modified version of the annular wall of the U-shaped opening of pad of the invention in which a laminate of three layers is used; and FIGS. 10A AND 10B are cross-sectional views showing a modified pad with no separate and distinct annular wall, which pad is provided with horizontal stiffeners to prevent the bulging out of the annular wall of the U-shaped opening of the pad.

DETAILED DESCRIPTION OF THE INVENTION

Figure 1:
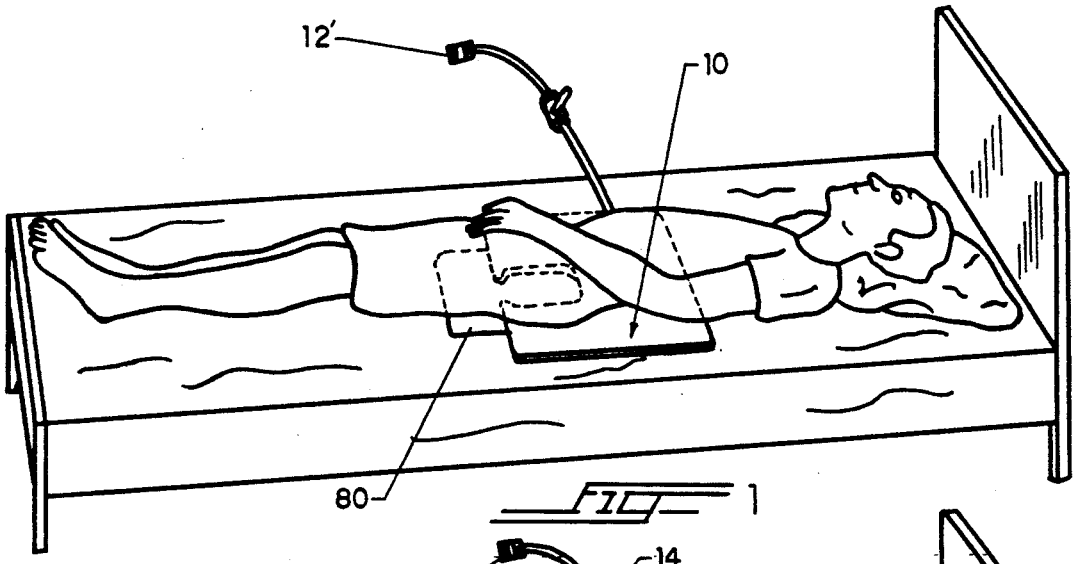
FIG. 1 is a perspective view showing the bed-pan support or pad of the invention in its collapsed state under a bed-ridden patient, where the support remains until it is inflated for use.
Figure 2:
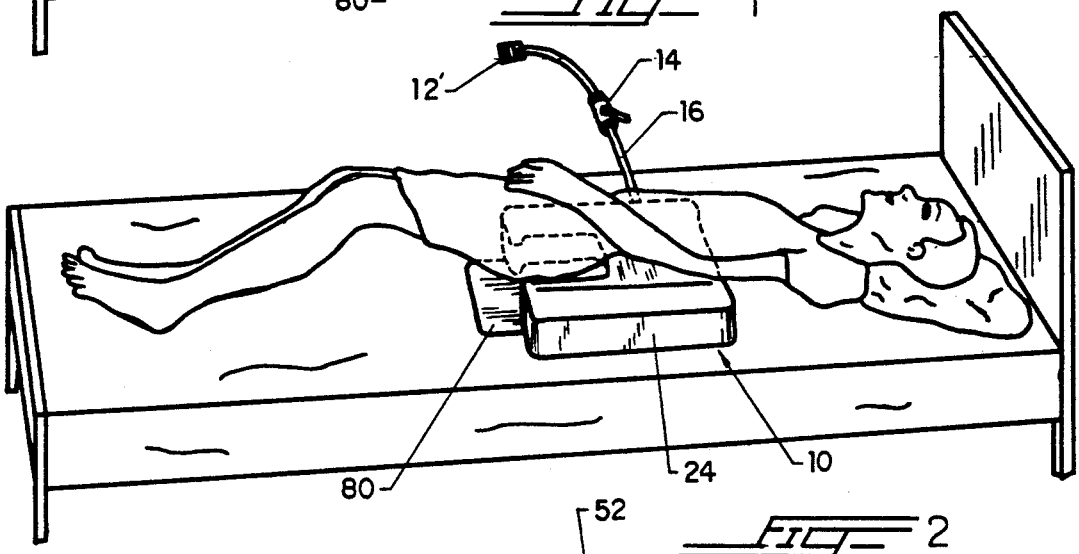
FIG. 2 is a perspective view showing the collapsible bed-pan support or pad of the invention in its inflated, ready-to-use state.
Figure 3:
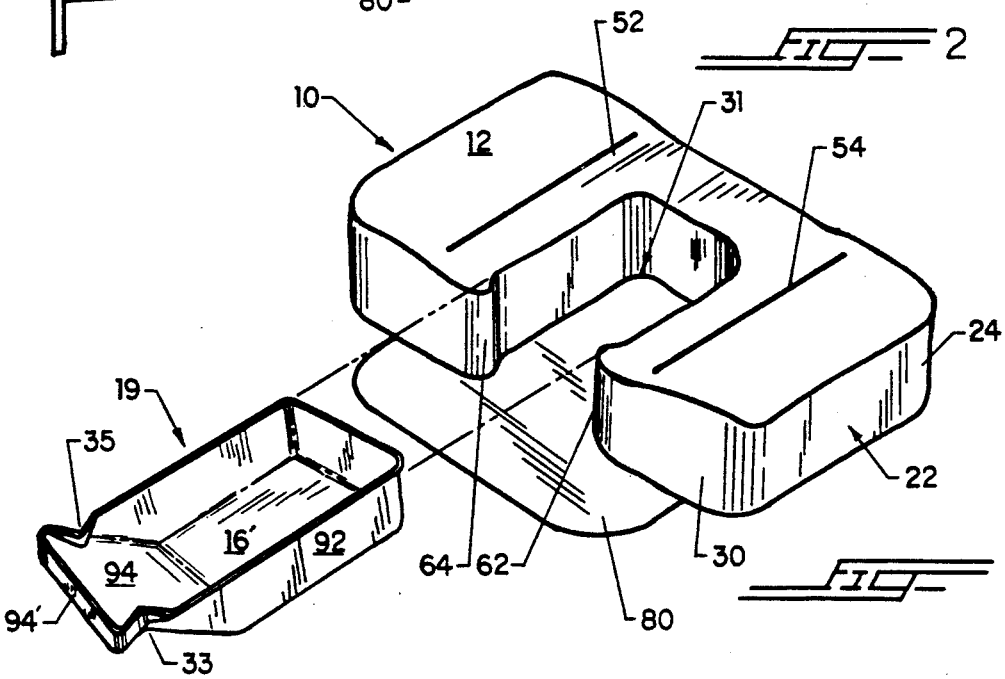
FIG. 3 is a perspective view similar to FIG. 2 showing the bed-pan support or pad of the invention in its erected, inflated state for use in receiving a bed pan of the invention.

Referring now to the drawings in greater detail, the collapsible, bed-pan support or pad for bed-ridden patients is indicated generally by reference numeral 10. The bed-pan support 10, in the preferred embodiment, is made of a thin layer of vinyl, in order to provide a superior cleaning and fast drying surface. This thin layer allows for the bed-pan pad 10 to be collapsed to a small thickness, which allows for the support to be positioned under the supine patient in its collapsed state, and, thereby, immediately ready for use via inflation. The bed-pan pad 10 has an upper support face 12 upon which the patient's back, buttocks area and thighs rest when the support is erected via a valve 14, tubing 16, and a compressed-air supply. This upper face 12 is covered over with a layer of rayon 17, forming a laminate, as seen in FIG. 6, which rayon layer provides a greater degree of comfort to the skin of the patient for absorbing moisture. The rest of outer surfaces of the pad have the vinyl facing outwardly to provide the advantages above-described. The pad 10 includes a flat or horizontally-disposed bottom support surface or layer 20, which rests directly on the bed. The perimetric edges of the two layers 12 and 20 are united by an annular or circumferential side wall surface 22 comprised of side walls 24, 26, rear wall 28, and front wall 30. The unit's front surface 30 defines a U-shaped opening 31 which receives a bed pan 23, seen in FIG. 3, which bed pan has a lower height than the height of the inflated pad. The pad's upper surface face is essentially flat and non-sloping. The interior of the support 10 is substantially hollow, except for a pair of flexible I-shaped connecting webs 40, 42, with each web defining an upper portion that is connected to an interior portion of the upper support surface 12, and a lower portion connected to an interior portion of the lower support surface 20, as seen in FIG. 6. The webs extend parallel to the length of the support 10. The webs are flexible enough, so that, when the pad 10 is collapsed, the upper layer 12 and the lower layer 20 may rest one upon the other, as seen in FIG. 1. The webs are centrally located, with each web being of lesser height than each of the side walls, in order to provide a concave or arched upper support surface, as seen in FIG. 6, which provides a contoured fit to the back of the patient. Each web may also be provided with holes for allowing the passage therethrough of the inflating gas to allow for uniform inflation. The I-beam shaped webs also define elongated, longitudinally-extending depressions or troughs 52, 54 for retaining the thighs of the patient in place on the pad 10. These troughs are formed by the upper surfaces of the webs being joined to the inner surface of the upper surface, which provides a tuck or depression groove in the top surface, as seen in FIGS. 3 and 5, which grooves run a distance slightly less than the length of the upper surface face 12.

Figure 7:
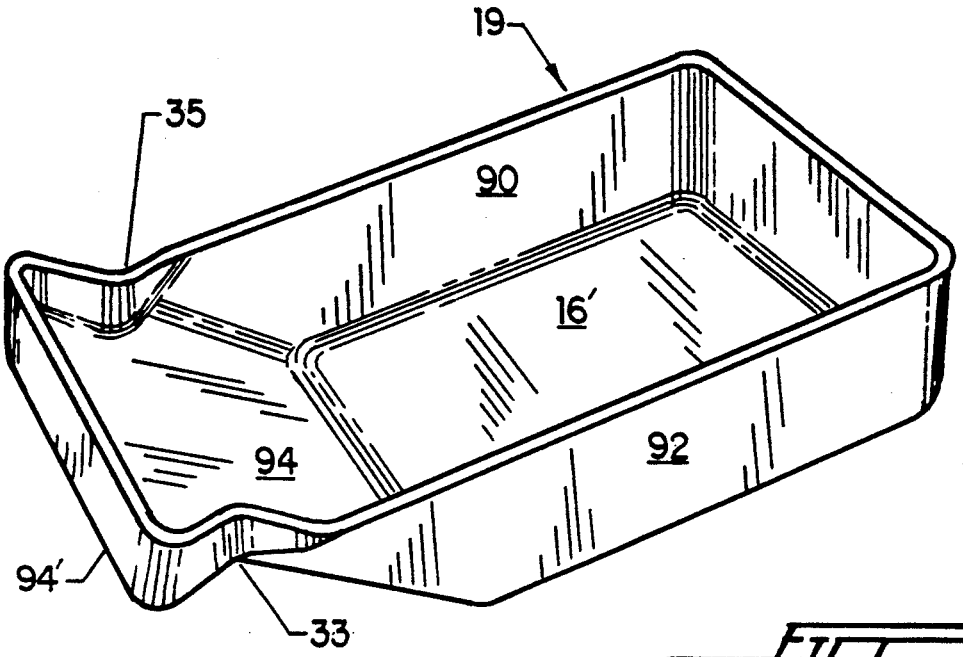
FIG. 7 is an isometric view of the novel bed-pan according to the invention.
Figure 8:
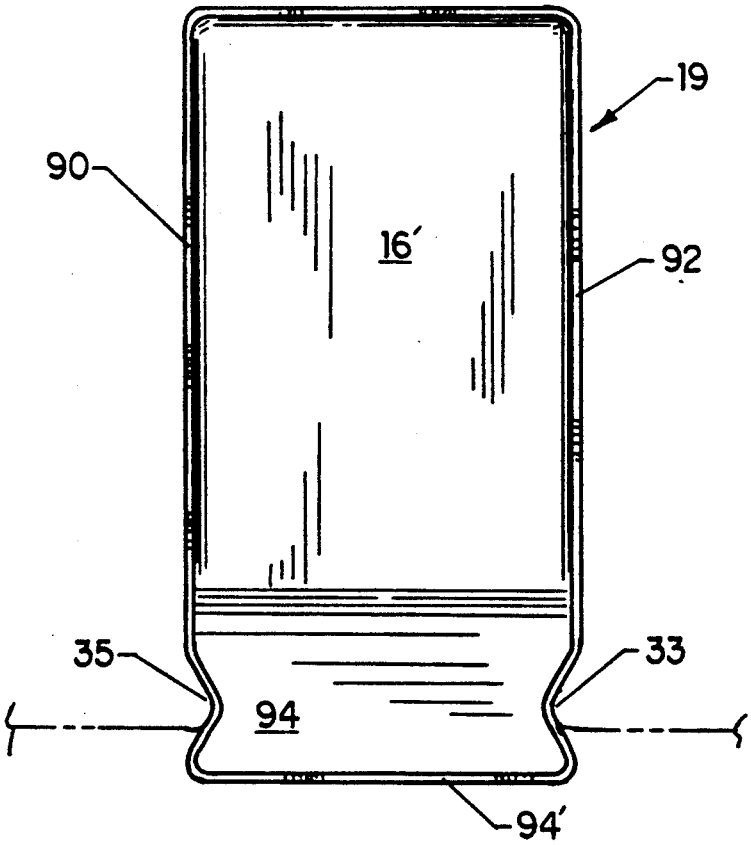
FIG. 8 is a top, plan view thereof.

The U-shaped cutout is provided with a pair of entrance, pincher-elements or camming members 62, 64 for retaining the bed pan 19 in the opening via the biasing force thereof when inflated. Each element 62, 64 is arcuate in shape, and narrows the entrance of the U-shaped opening to a width that is smaller than the width of the bed pan 19. The bed pan 19, best seen in FIGS. 7 and 8, is provided with a pair of indented cutouts 33, 35 that serve as retaining notches for receiving the catches or camming elements 62, 64, whereby the bed pan is held in place in the U-shaped opening, so that it will not accidentally come out therefrom. Each camming or retaining member has an outwardly-facing, curved surface 62', 64' that allows the bed pan to force these elements 62, 64 inwardly while inserting the bed pan 19, which elements 62, 64 will automatically resume their original positions as soon as the cutouts 33, 35 of the bed pan are in lateral alignment with the elements 62, 64.

The bed pan 19 has a main receptacle portion 16' having a pair of side walls 90, 92, and a forward wall 94, with the forward wall having a forwardly, upwardly-sloping, handle-like, upper extension 94' formed and projecting from the upper rim of the forward wall. The pair of oppositely-disposed, mutually-facing cooperating cutouts 33, 35 are formed in the side edge surfaces of the handle-like extension 94' for receiving the pair of oppositely-disposed, arcuate, mutually-facing protuberances 62, 64 at the entrance of the opening of the pad, whereby the bed pan 16 is resiliently and removably retained in the opening, as described above. The side walls of the receptacle 16' have a height less than the height of the pad 10 when the pad is inflated. The handle-like extension 94' is elevated above the upper rim of the side walls of the receptacle to serve as a splash guard during urination. By placing the cutouts 33,35 in the side edge surfaces of the handle-extension, the retaining protuberances 62, 64 are only in contact with a relatively lower-height mating cutout, in order to facilitate insertion and removal of the bed pan into and out of the U-shaped opening, so that during removal, spillage of the waste in the bed pan 19 will not occur. Such spillage would occur if a larger forcer were required to pull the bed pan out, such larger force necessarily imparting inertia to the waste matter in the receptacle 16', which inertia would cause the above-noted spillage once the bed pan is brought to a rest. Moreover, by placing the cutouts 33, 35 at such a relatively high elevation, when pulling the bed pan out after use by a patient, the reaction forces between the walls of the cutouts 33, 35 and the protuberances 62, 64 will tend to cause clockwise torques to the bed pan 19 about a fulcrum delineated between the two cutouts 33, 35, thereby preventing the waste material from moving forwardly, which if did occur, would aggravate the spillage problem owing to the above-mentioned inertia of the waste products during removal. In addition, the narrow entrance defined between the two protuberances 62, 64 of the U-shaped opening of the pad will also prevent vertical rotation of the bed pan during removal, thus increasing the stability of the removal process, and thereby further obviating the chances of spillage of waste material.

The front, annular surface or wall 22 of the U-shaped cutout is provided with an interior, supporting layer 72 of rayon, or the like, as best seen in FIG. 6. This interior layer 72 provides additional buttressing to the annular wall 22 in order to prevent the bulging out of the annular wall when the pad 10 is inflated. Prior-art pads have allowed the annular surface of the opening to bulge out, to form a outwardly-extending convex shape, which bulging out causes an inserted bed pan to tend to be forced out from the U-shaped opening of the pad through the entrance thereof, which, of course, is a considerable problem when the bed pan and pad are being used under a patient. Such bulging out of the annular walls worsens the more the pad is inflated. In U.S. Pat. No. 3,728,744—Kimbro et al, for example, after fully inflating the pad thereof, the U-shaped opening for receiving a bed pan is so restricted in size because of the bulging of the annular surface forming the U-shaped opening, that the use of a bed pan for obese persons posed a serious problem. Also, making the U-shaped opening of greater size, in order to overcome the bulging of the annular walls of the U-shaped opening, allowed the buttocks of the patient to sag, which created an obstacle to the insertion of the bed pan into the U-shaped opening. The reinforcing layer 72 prevents such bulging, to thereby effectively overcome these above-noted problems, ensuring that the very same pad and bed pan of the invention may be used for all sizes of patients, with comfort and with surety, and without sagging of the buttocks. The laminate of a layer of rayon 72 and layer of vinyl are heat-welded to the rest of the annular, or vertical, surfaces of the pad 10 by conventional welding techniques. Using this reinforced annular wall to prevent bulging effectively increases the width of the opening about ¾ inch, whereby the shape of the opening will better match the flat wall surfaces of the bed pan itself, thereby eliminating the difficulty of insertion and retention of the bed pan in the U-shaped opening, and also allowing for the precise size of width-opening so that large-sized patients may be accommodated without the bed pan being fitted loosely in the opening. Thus, the present invention allows for the use of a wider bed pan, with the very same size and type of bed pan being used for various sizes of patients.

The pad 10 of the invention is also provided with a bottom apron portion 80 that closes off the bottom of the U-shaped opening, in order to prevent the bed sheets from becoming soiled during use of the bed pan. The apron portion is formed as an integral part of the bottom wall of the pad 10, with the bottom wall initially cut and formed into the shape seen in the figure, which cut shape is then heat welded to the bottom portions of the annular wall surfaces. The apron has a length greater than the length of the pad itself, in order to protect the sheets from spillage, or the like. The entire bottom wall with apron portion is also made of two layers: A first upper layer 84 of vinyl, like the rest of the pad 10, and a bottom layer 86 of rayon, or the like, as seen in FIG. 6, which bottom layer has a greater coefficient of static friction than the vinyl, in order to prevent slippage of the apron, and thus the integrally-joined pad, from under the patient while the patient is using the bed pan. It is, of course, possible to use rubber, or other heat-fusible, elastic, flexible material, instead of vinyl, and to use nylon, cotton, and the like, instead of rayon. Unlike prior-art aprons for pads for bed pans, such as that disclosed in U.S. Pat. No. 4,207,633— Smith, et al—the apron of the present invention is part of the bottom of the pad itself, so that the waste from the patient cannot enter into the area between the bottom of the pad and the apron as in Smith, et al. In the pad 10, the apron 80 is an integral portion of the bottom surface 20 , and not a separate layer as in Smith, et al.

As mentioned above, the pad has a tubing 12 and valve 14 by which a compressed-air supply may inflate the pad. The tubing 12 has a conventional quick-disconnect 12' by which a tube of the compressed-air supply may be quickly and easily connected and disconnected from the pad . The valve 14 is a conventional, manually-rotatable valve assuming an "on" and an "off" position. The "off" position is used when disconnecting the compressed-air supply so that the pad does not deflate, for using the pad for receiving in its U-shaped opening a portable perineal cleansing and drying device that washes clean and dries the patient after using the bed pan. The perineal cleansing and drying device and the compressed-air supply, and their method of use with the pad 10, are disclosed in copending application Ser. No. 07/760,062, filed on Sep. 13, 1991.

In a modified form of the annular wall of the U-shaped opening shown in FIG. 9, instead of a laminate of two layers, a laminate of three layers is provided: A first and second outer layer 100, 102 made of vinyl, or the like, and a third stiffening, inner layer 104 made of rayon, or the like. The outer layer 100 is longer that the two other layers in order to provide tabs 106, 108 for welding to the ends of the rest of the annular wall of the pad. After welding the tabs 106, 108 of the rest of the annular surface of the pad to the end edges of the rest of the annular surface of the pad, and after welding the top and bottom edges of the first, outer layer to the lateral interior edges of the top and bottom surfaces of the pad, the distinctive U-shaped opening is formed by the three layers 100, 102, 104.

FIGS. 10A and 10B shows a modified pad 110. The pad 110 differs from the pad 10 in that there is not provided a separate annular, vertical surface. The pad 110 in this manner is similar to the pad disclosed in U.S. Pat. No. 3,728,744—Kimbro, et al, where there is provided only a top surface and bottom surface that are bonded together along mutually-contacting peripheral edge surfaces. As explained supra, the considerable problem with the pad of that patent is that, when inflated, the annular wall of the U-shaped opening bulged out the more the pad is inflated, thus infringing upon the space of the U-shaped opening 110', and thus preventing proper insertion and retention of a bed pan in the U-shaped opening. The pad 110 of the invention overcomes this problem by providing horizontal buttressing webs 112, 114 between the interior edges of the U-shaped opening and the side walls 116, 118 of the pad 110. Each web 112, 114 has an interior end 112', 114' that is welded to the interior part of the edge-joinder 118 of the top and bottom surfaces. The horizontal webs are also preferably made of vinyl.

While the pad 10 may be removed after every use of the bed pad, it is possible to allow it to remain under the patient. Toward this end, a separate, independent foam cushion may be provided having the same general shape of the pad 10. The cushion is placed on top of the upper surface of the pad 10, upon which cushion the patients rests, whereby the uneven upper surface of the pad 10 does not contact the patient during the non-use of the pad for holding a bed pan, to thus provide greater comfort.

While a specific embodiment of the invention has been shown and described, it is to be understood that numerous changes and modifications may be made therein without departing from the scope, spirit and intent of the invention as set forth in the appended claims.

What I claim is:

1. A collapsible bed-pan pad for bed-ridden persons, and the like, comprising:

an upper body-supporting surface;

a lower flat surface for resting on a bed, or the like;

an annular surface connecting said upper surface and said lower surface together and defining a substantially hollow interior that may be inflated for erecting the bed-pan support; said annular surface defining a front surface, and rear surface, a first side surface, and a second side surface, the length of said upper body-supporting surface extending in a direction from said front surface toward said rear surface;

said front surface of said annular surface comprising a portion thereof defining a cutout for receiving a bed pan, said cutout being bounded by said portion of said front annular surface;

means in at least one of said surfaces for allowing inflation of said substantially hollow interior;

at least a part of said portion of said front annular surface forming said opening comprising a laminate having a first, outer layer of flexible, elastic material, and a second, inner layer facing said hollow interior of reinforcing material in order to prevent the outward bulging of said portion of said front annular surface when the pad is inflated, whereby said portion of said front surface does not interfere with the insertion and retention of a bed pan in said opening.

2. The collapsible bed-pan pad for bed-ridden persons according to claim 1, wherein said first layer of said portion of said front annular surface is made from at least one of: Vinyl and rubber; and said second layer is made of at least one of: rayon, nylon, and cotton.

3. A collapsible bed-pan pad for bed-ridden persons according to claim 2, wherein said upper surface also comprises an opening of the same general shape as said opening of said front annular surface; said lower surface comprising a laminated sheet having an integral apron member closing off said opening of said front annular surface from below; said apron member having a forward portion projecting outwardly beyond said front annular surface, said apron member protecting the bed below the patient using the pad; said laminated lower surface comprising an upper layer made of flexible, elastic material, and a bottom layer made of material providing a higher coefficient of friction in order to stabilize said pad on a bed; said inner layer and said bottom layer being made of the same first material, and said outer layer an said upper layer being made of the same second material different from said first material.

4. The collapsible bed-pan pad for bed-ridden persons according to claim 1, wherein said upper surface also comprises an opening of the same general shape as said opening of said front annular surface; said lower surface comprising a laminated sheet having an integral apron member closing off said opening of said front annular surface from below; said apron member having a forward portion projecting outwardly beyond said front annular surface, said apron member protecting the bed below the patient using the pad; said laminated lower surface comprising an upper layer made of flexible, elastic material, and a bottom layer made of material providing a higher coefficient of friction in order to stabilize said pad on a bed.

5. The collapsible bed-pan pad for bed-ridden persons according to claim 4, wherein said upper layer is made from at least one of: Vinyl and rubber; and said bottom layer is made of at least one of: rayon, nylon, and cotton.

6. The collapsible bed-pan pad for bed-ridden persons according to claim 4, wherein said forward portion of said apron member has a width greater than the width of said opening, said width being taken in a direction between said side walls.

7. The collapsible bed-pan for bed-ridden persons according to claim 1, wherein said opening is U-shaped.

8. The collapsible bed-pan bed for bed-ridden persons according to claim 1, wherein all of said portion of said front annular surface comprises said laminate.

9. The collapsible bed-pan pad for bed-ridden persons according to claim 1, wherein said cutout of said front surface of said annular surface comprises an entrance, and a pair of bed-pan retaining members for resiliently holding a bed pan in said cutout; said retaining members comprising a pair of oppositely-disposed, arcuate, mutually-facing protuberances at said entrance of said opening; the lateral distance between said protuberances being less than the lateral width of said opening directly adjacent thereto.

10. The collapsible bed-pan pad for bed-ridden persons according to claim 9, further comprising a bed pan having a main receptacle portion, said receptacle portion comprising a pair of side walls, and a forward wall having means for allowing the gripping of the bed pan thereby during insertion of the bed pan into said opening, and removal of the bed pan from said opening; said receptacle comprising a pair of oppositely-disposed, mutually-facing cooperating cutouts for receiving said pair of oppositely-disposed, arcuate, mutually-facing protuberances at said entrance of said opening, whereby said bed pan is resiliently, removably retained in said opening.

11. The collapsible bed-pan pad for bed-ridden persons according to claim 10, wherein said pair of oppositely-disposed, mutually-facing cooperating cutouts are formed in said means for allowing the gripping of the bed pan; said means for allowing the gripping having a pair of side edge walls in which said cutouts are formed and being elevated above the upper rim of said side walls of said receptacle.

12. In a combination of a collapsible bed-pan pad and bed pan for bed-ridden persons, and the like, comprising:

said bed-pan pad comprising an upper body-supporting surface;

a lower flat surface for resting on a bed, or the like;

an annular surface connecting said upper surface and said lower surface together and defining a substantially hollow interior that may be inflated for erecting the bed-pan support; said support surface defining a front surface, and rear surface, a first side surface, and a second side surface, the length of said upper body-supporting surface extending in a direction from said front surface toward said rear surface;

said front surface of said annular surface comprising a portion thereof defining a cutout for receiving a bed pan, said cutout being bounded by said portion of said front annular surface;

means in at least one of said surfaces for allowing inflation of said substantially hollow interior;

said cutout of said front surface of said annular surface comprising an entrance, and a pair of bed-pan retaining members for resiliently holding a bed pan in said cutout; said retaining members comprising a pair of oppositely-disposed, arcuate, mutually-facing protuberances at said entrance of said-opening; the lateral distance between said protuberances being less than the lateral width of said opening directly adjacent thereto; and said bed pan having a main receptacle portion, said receptacle portion comprising a pair of side walls each having an upper rim, and a forward wall, said forward wall having means for allowing the gripping of the bed pan thereby during insertion of the bed pan into said opening, and removal of the bed pan from said opening; said receptacle comprising a pair of oppositely-disposed, cutouts for receiving said pair of oppositely-disposed, arcuate, mutually-facing protuberances at said entrance of said opening, whereby said bed pan is resiliently, removably retained in said opening, said means for allowing the gripping comprising an inclined, splash-guard handle-section;

the height of said bed pan side walls being less than the height of said front annular surface when the pad is inflated; said pair of oppositely-disposed, arcuate, mutually-facing protuberances at said entrance of said opening extending approximately the full height of said front annular surface; said pair of cutouts being formed in said handle section of the bed pan; said handle section having a pair of side edge surfaces in which said cutouts are formed and being elevated above said upper rims of said side walls of said receptacle; said inclined handle-section also serving as a splash-guard.

13. In a collapsible bed-pan support for bed-ridden persons, and the like, comprising:

an upper body-supporting surface;

a lower flat surface for resting on a bed, or the like;

an annular surface connecting said upper surface and said lower surface together and defining a substantially hollow interior that may be inflated for erecting the bed-pan support; said annular surface defining a front, feed-end surface, and rear, head-end surface, a first side surface, and a second side surface, the length of said upper body-supporting surface extending in a direction from said front surface toward said rear surface;

said front surface of said annular surface defining a U-shaped cutout for receiving and supporting a bed pan, said U-shaped cutout having a length taken in a first direction from said feed-end surface toward said head-end surface, and a width taken in a second direction transverse to said first direction, the width of said U-shaped being large enough for receiving therein a conventional bed pan;

a bed pan for reception in said U-shaped opening;

one of said surfaces having a valve for injecting an inflating gas into said substantially hollow interior;

said upper support surface comprising a pair of troughs, one of one lateral side of said cutout, and the other on the other lateral side of said U-shaped cutout for supporting and resting thereon a thigh of the patient, each said trough comprising at least one portion thereof that extends at least along one portion of the length of said U-shaped cutout with said at least one portion of said trough and said at least one portion of the length of said U-shaped cutout being coextensive in a side-by-side relationship.

14. The collapsible bed-pan support for bed-ridden persons according to claim 13, wherein each of said pair of troughs comprises an elongated depression groove extending approximately along said length of said upper surface on the respective lateral side of said U-shaped cutout.

15. The collapsible bed-pan pad for bed-ridden persons, and the like, according to claim 13, further comprising web means for reinforcing said annular edge surface, said web means comprising at least one end secured to at least a portion of at least one of said annular edge surfaces at said bed-pan opening, and a second end secured to another portion of at least one of said top and bottom surfaces for preventing the bulging out of said surfaces into said opening when the pad is inflated.

16. The pad according to claim 15, wherein said web means comprises a first web having a first end secured to a first portion of joinder of said annular edge surfaces at said opening, and a second end secured to a first portion of at least one of said top and bottom surfaces diametrically opposite said first portion of joinder, and a second web having a first end secured to a second portion of joinder of said annular edge surfaces at said opening, and a second end secured to a second portion of at least one of said top and bottom surfaces diametrically opposite said second portion of joinder.

* * * * *